US007540244B2

(12) United States Patent
Gregory

(10) Patent No.: US 7,540,244 B2
(45) **Date of Patent: *Jun. 2, 2009**

(54) SHELF BRACKET LOCK

(75) Inventor: Michael A. Gregory, Cuyahoga Falls, OH (US)

(73) Assignee: Rubbermaid, Incorporated, Huntersville, NC (US)

( * ) Notice: Subject to any disclaimer, the term of this patent is extended or adjusted under 35 U.S.C. 154(b) by 103 days.

This patent is subject to a terminal disclaimer.

(21) Appl. No.: 11/275,283

(22) Filed: Dec. 21, 2005

(65) Prior Publication Data

US 2006/0175495 A1 Aug. 10, 2006

Related U.S. Application Data

(60) Provisional application No. 60/637,983, filed on Dec. 21, 2004.

(51) Int. Cl.
*A47B 9/00* (2006.01)

(52) U.S. Cl. ..... 108/108; 248/220.41

(58) Field of Classification Search ..... 248/250, 248/220.22, 222.13, 222.11, 222.12, 220.41, 248/220.42, 249, 220.31; 108/108, 157.13, 108/181, 146, 147.11, 147.14, 180, 106, 108/107, 147.17; 211/90.02, 90.03, 186, 211/187, 192, 208, 106, 106.01, 193, 191, 211/103, 190, 207, 57.1, 59.1, 54.1, 7; 403/329, 403/397, 399, 375, 326, DIG. 14; 411/508, 411/913; 292/137, 163, 146, 150, 302
See application file for complete search history.

(56) References Cited

U.S. PATENT DOCUMENTS

| | | | | | |
|---|---|---|---|---|---|
| 1,176,588 | A | * | 3/1916 | Miller et al. | 248/250 |
| 1,998,343 | A | * | 4/1935 | Teller et al. | 126/339 |
| 2,477,771 | A | * | 8/1949 | Sanford | 248/247 |
| 3,092,047 | A | * | 6/1963 | Chesley | 108/137 |
| 3,321,089 | A | * | 5/1967 | Krikorian | 211/134 |
| 3,355,134 | A | * | 11/1967 | Chesley | 248/250 |
| 3,565,381 | A | * | 2/1971 | Oliver | 248/243 |
| 4,010,697 | A | * | 3/1977 | Einhorn | 108/93 |
| 4,283,035 | A | * | 8/1981 | Ojembarrena et al. | 248/263 |
| 4,301,767 | A | * | 11/1981 | Willinger et al. | 119/245 |
| 4,624,376 | A | * | 11/1986 | Bertram | 211/187 |
| 4,658,968 | A | * | 4/1987 | Mastrodicasa | 211/187 |
| 4,658,969 | A | * | 4/1987 | Mastrodicasa | 211/187 |
| 5,467,721 | A | * | 11/1995 | Gosch | 108/146 |

(Continued)

FOREIGN PATENT DOCUMENTS

EP 1039198 A1 * 9/2000

(Continued)

*Primary Examiner*—José V Chen
*Assistant Examiner*—Matthew W Ing
(74) *Attorney, Agent, or Firm*—Dennis J. Williamson; Moore & VanAllen, PLLC

(57) ABSTRACT

A locking bracket system comprises a bracket lock and a bracket. The bracket lock may be slidably positioned along the lateral length of the bracket to transition between locked and unlocked configurations. When locked, an upper cantilever tab on the bracket lock secures a wire frame shelf that is recessed in a groove on the bracket. When unlocked, the wire frame shelf is not obstructed by the bracket shelf lock and may be removed. A solid shelf may be used in combination with the locking bracket system, as the bracket shelf lock does not obstruct the shelving plane upon which the solid shelf sits.

12 Claims, 3 Drawing Sheets

U.S. PATENT DOCUMENTS 5,511,311 A * 4/1996 Collins ..... 30/162
6,024,333 A * 2/2000 Raasch et al. ..... 248/247
6,546,585 B1 * 4/2003 Blaustein et al. ..... 15/167.1
7,055,786 B2 * 6/2006 Garassino et al. ..... 248/220.22
7,188,740 B2 * 3/2007 Marchetta et al. ..... 211/106
7,240,803 B2 * 7/2007 Stitchick et al. ..... 211/106

FOREIGN PATENT DOCUMENTS

WO WO 2004/056236 * 7/2004

* cited by examiner 44
22
46
28
26
30
32
43
24a
10
48
50a
50b
24b 22
16
28
38
26
30
32
40
43
48
24a
41
36
34

13
20
38
41
40
22
24a
34
12
16
43
41
10
36
14
16
18
45
42

SHELF BRACKET LOCK

RELATED APPLICATION DATA

This application claims priority to U.S. Provisional application No. 60/637,983, filed Dec. 21, 2004, as to all subject matter commonly disclosed therein.

FIELD OF THE DISCLOSURE

The present invention generally relates to a shelf bracket for use with a wire shelf or a solid shelf, and more particularly to a shelf bracket having a lock for locking a wire shelf to the bracket.

BACKGROUND OF THE DISCLOSURE

Brackets for shelving have been traditionally designed specifically for one particular style of shelf, namely, either a wire shelf or a solid shelf made out of metal, wood, plastic, or the like. Brackets for wire shelves typically include at least one groove for receiving a wire formed on the wire shelf. A clamp can be employed to prevent removal of the wire from the groove of the bracket. However, the presence of the clamp on a wire-shelf bracket obstructs the shelving plane defined by the upper surface of the bracket and makes the use of the wire-shelf bracket with a solid shelf difficult if not impossible. Brackets for solid shelves typically have a flat surface for supporting the shelf and may include apertures for receiving threaded fasteners or the like. Prior art brackets have not been used effectively for both solid and wire shelves.

BRIEF DESCRIPTION OF THE DRAWINGS

Objects, features, and advantages of the present disclosure will become apparent upon reading the following description in conjunction with the drawing figures, in which.

DETAILED DESCRIPTION OF THE DISCLOSURE

Figures 1, 2, 3:
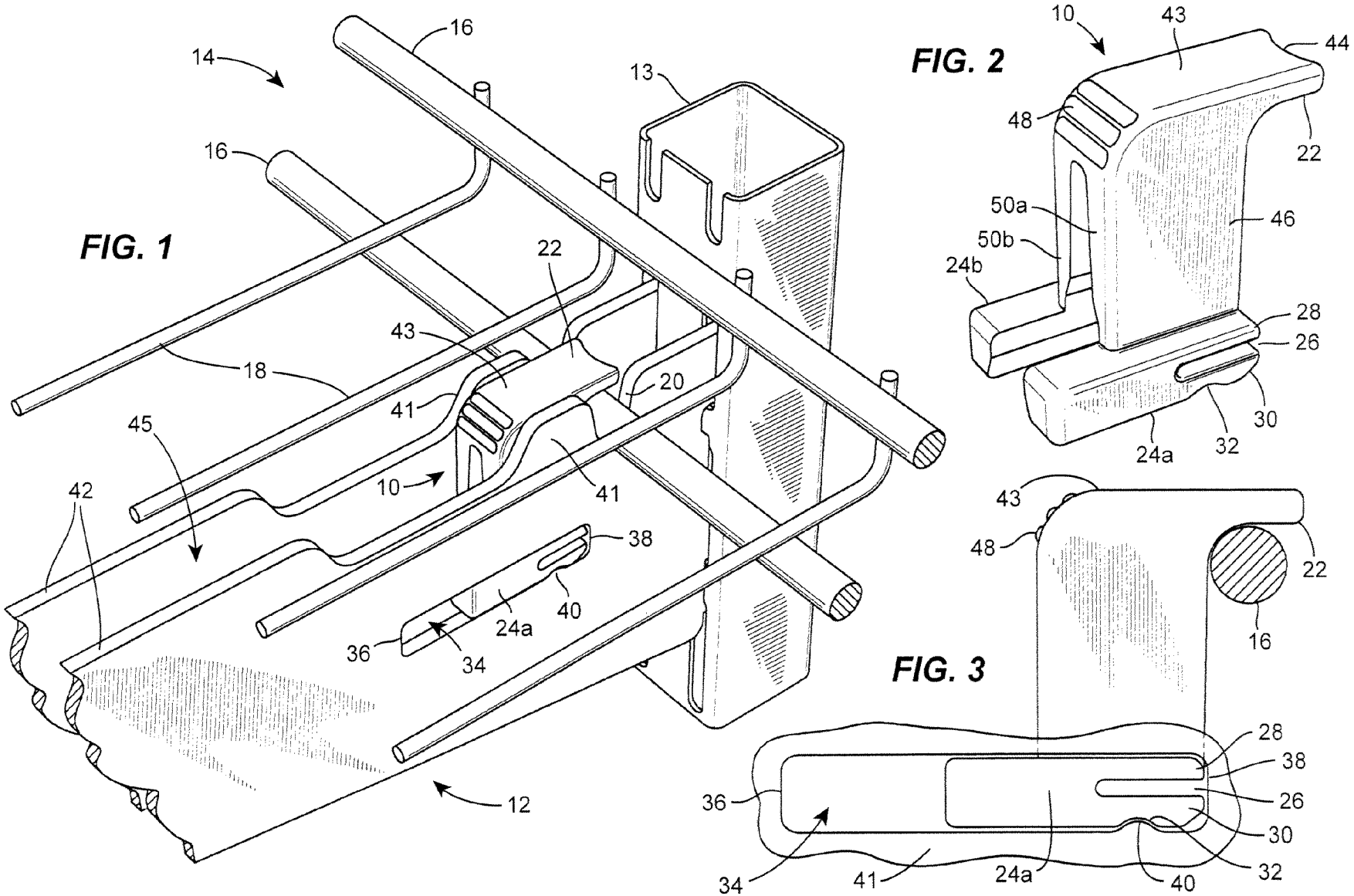
FIG. 1 shows a partial perspective view of one example of a locking bracket system in a locked configuration constructed in accordance with the teaching of the present disclosure.
FIG. 2 shows a perspective view of the shelf bracket lock from the locking bracket system of FIG. 1.
FIG. 3 shows a partial side view of a locked configuration of the locking bracket system of FIG. 1.

The bracket lock and bracket described herein in accordance with the teachings of the present disclosure solve or improve upon the problems and limitations described above, as well as other deficiencies, that are known in the prior art. For example, the disclosed shelf bracket lock can be used with a shelf bracket operable for supporting either a wire shelf or a solid shelf because the bracket lock is designed to either be flush with or extend above a top surface of the bracket and thus does not obstruct a solid shelf from lying flat on the top surface of the bracket. A wire shelf is secured by placing the shelf into a groove formed in the shelf bracket. The bracket lock is urged in a horizontal direction so as to constrain the wire within the groove of the shelf bracket. The shelf bracket and shelf bracket lock can be made of any suitable material such as plastic, metal, or composite. Plastic material can be made from polypropylene, nylon, or acetal, but is not limited to these materials.

Referring now to FIGS. 1-5, a shelf bracket lock 10 is operably connected to a shelf bracket 12. The shelf bracket 12 can be connected to a vertical post 13 or upright disclosed in the present example, but can alternatively be attached directly to a wall or the like. A wire shelf 14 can include relatively large diameter wires 16 disposed along the longitudinal axis of the shelf. The large wires 16 operate to provide a stiff frame for laterally disposed wires 18 connected transversely to the wire 16. The wire shelf 14 also has terminal longitudinal wires 17 that are connected to the laterally disposed wires 18 and provide strength and stability to the wire shelf 14 structure. The bracket 12 includes at least one groove 20 for receiving therein a portion of one of the longitudinal wires 16. The bracket 12 also includes at least one terminal bracket tab 19 that may be received by a gap in the wire shelf 14 structure defined by the mesh of laterally disposed wires 18 and terminal longitudinal wires 17.

The shelf bracket lock 10 includes an upper cantilever tab 22 that can be slid over the top of the longitudinal wire 16 to prevent the wire shelf 14 from being displaced from the bracket 12. The shelf bracket lock 10 includes a pair of lower sliding portions 24*a* and 24*b* seen best in FIG. 2. Each lower sliding portion 24*a*, 24*b* includes a slot 26 formed between an upper finger 28 and a lower cantilever tab 30. The lower cantilever tab 30 includes a recessed surface 32 for holding the lock 10 in a forward position.

Figure 4:
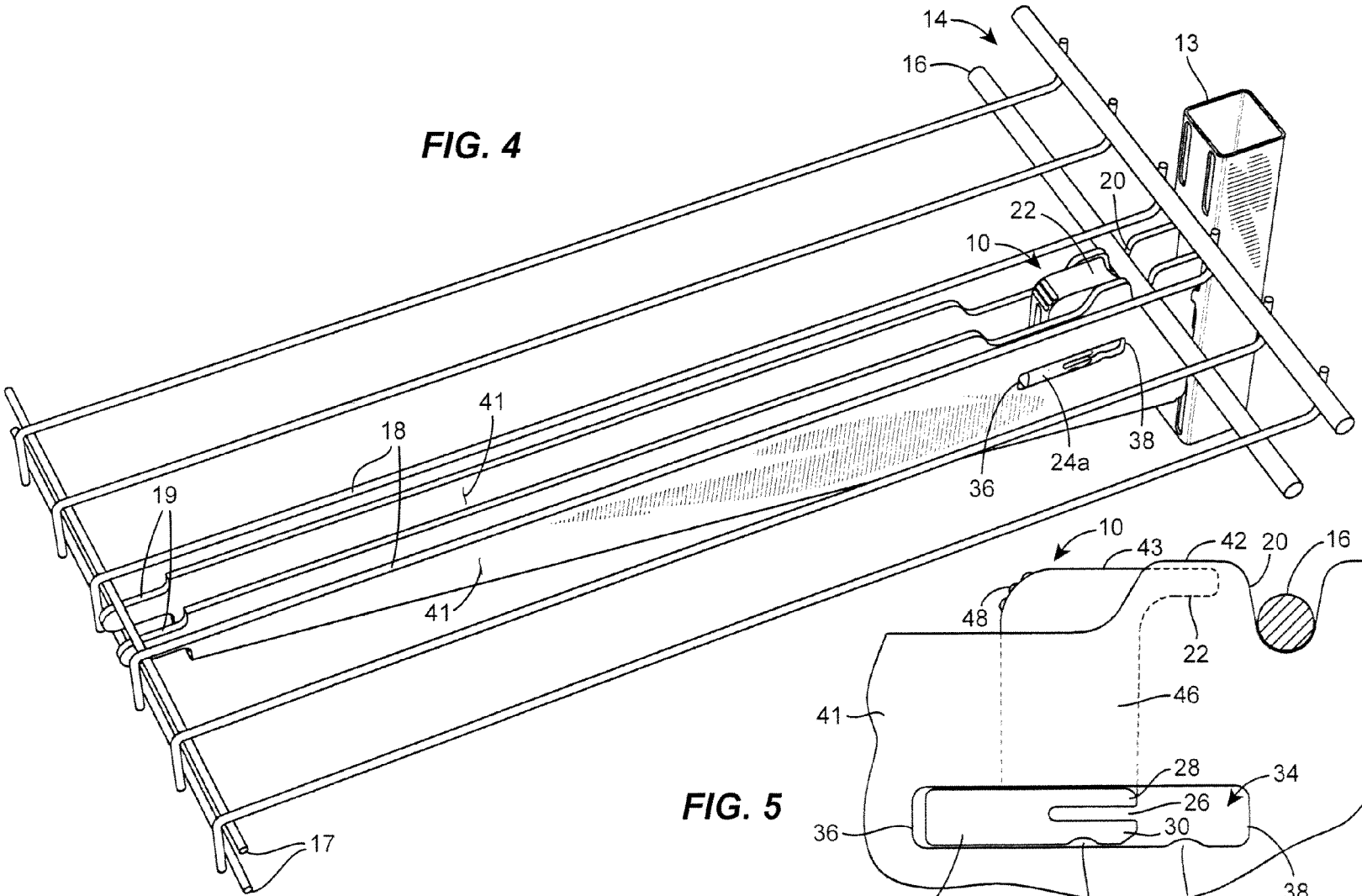
FIG. 4 shows a perspective view of an unlocked configuration of the locking bracket system of FIG. 1.
Figure 5:
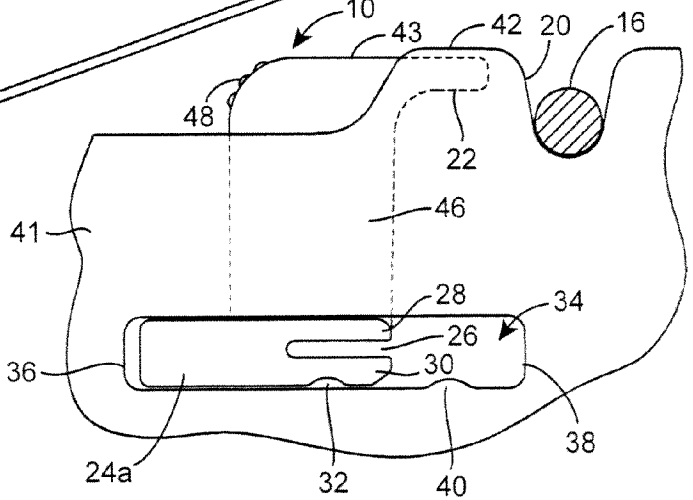
FIG. 5 shows a partial side view of an unlocked configuration of the locking bracket system of FIG. 1.

The bracket 12 includes a slot 34 having first and second ends 36, 38 disposed on a sidewall 41. The lower sliding portions 24*a*, 24*b* of the bracket lock 10 reciprocatingly slide between the first and second ends 36, 38. When in a locked configuration (as best seen in FIGS. 1 and 3), the lower sliding portions 24*a*, 24*b* are positioned at the second end 36, and the shelf bracket lock 10 is engaged such that the upper cantilever tab 22 obstructs the groove 20, thus preventing the removal of the wire 16 from the bracket 12. When in an unlocked configuration (as best seen in FIGS. 4 and 5), the lower sliding portions 24*a*, 24*b* are positioned at the first end 36, and the shelf bracket lock 10 is disengaged such that the upper cantilever tab 22 does not obstruct the groove 20, thus permitting the removal of the wire 16 from the groove 20 of the bracket 12. The slot 34 of the bracket 12 includes a raised portion 40 corresponding to the recessed surface 32 of the lower cantilever tab 30 of the lower sliding portions 24*a*, 24*b*. The raised portion 40 provides a positive detent with the recessed surface 32 to prevent the shelf bracket lock 10 from being inadvertently disengaged from the locked position corresponding to the second end 38 of the slot 34. The bracket 12 includes an upper surface 42 that defines a shelving plane 45 that is either above or substantially flush with a top surface 43 of the shelf bracket lock 10.

Referring now to FIG. 2, the shelf bracket lock 10 is shown in detail. The upper cantilever tab 22 includes an arcuate surface 44 formed in the leading edge thereof The arcuate surface 44 provides a grip for a person's finger to pull the shelf bracket lock 10 into the unlocked position at the first end 36 of the slot 34 in the bracket 12. A body portion 46 extends between the upper tab 22 and the lower tabs 24*a*, 24*b*. The body portion 46 includes a rounded, knurled surface 48 at the transition to the upper tab 22. The knurled surface 48 provides a grip for a person's finger to push the shelf bracket lock 10 toward the locked position at the second end 38 of the slot 34 in the bracket 12. The body portion 46 includes a pair of legs 50*a*, 50*b* that extend between the upper cantilever tab 22 and the lower sliding portions 24*a*, 24*b*.

In an alternate embodiment of the shelf bracket lock 10, the upper cantilever tab 22 includes an upper recessed surface (not shown). The upper recessed surface conforms substantially to the outer surface of wire 16 when the shelf bracket lock 10 is in a locked position.

In operation, the bracket 12 is connected to a vertical post 13 or the like. The wire shelf 14 can be positioned such that the terminal bracket tabs 19 extend through the open plane defined by the terminal longitudinal wires 17 and the laterally disposed wires 18, and then one longitudinal wire 16 can be placed in the groove 20 of the bracket 12. The shelf bracket lock 10 is then pushed towards the second end 38 of the slot 34 formed in the bracket 12. When the lower cantilever tab 30 of the lower sliding portion 24*a*, 24*b* is initially pushed over the raised surface 40 in the slot 34, the lower cantilever tab 30 moves upward as its slides over the raised surface 40. When the lower cantilever tab 30 is pushed far enough, the recessed surface 32 is positioned over the raised surface 40, and the lower cantilever tab 30 then snaps down into place and prevents the shelf bracket lock 10 from inadvertently becoming unlocked. In this way, the shelf bracket lock 10 prevents vertical displacement, the groove 20 prevents lateral displacement, the interaction of the sidewall 41 and the laterally disposed wires 18 prevents substantial longitudinal displacement, and the terminal bracket tabs prevent substantial rotation of the wire frame 14 about the longitudinal wire 16, thereby maintaining the wire frame 14 in a fixed position.

Figure 6:
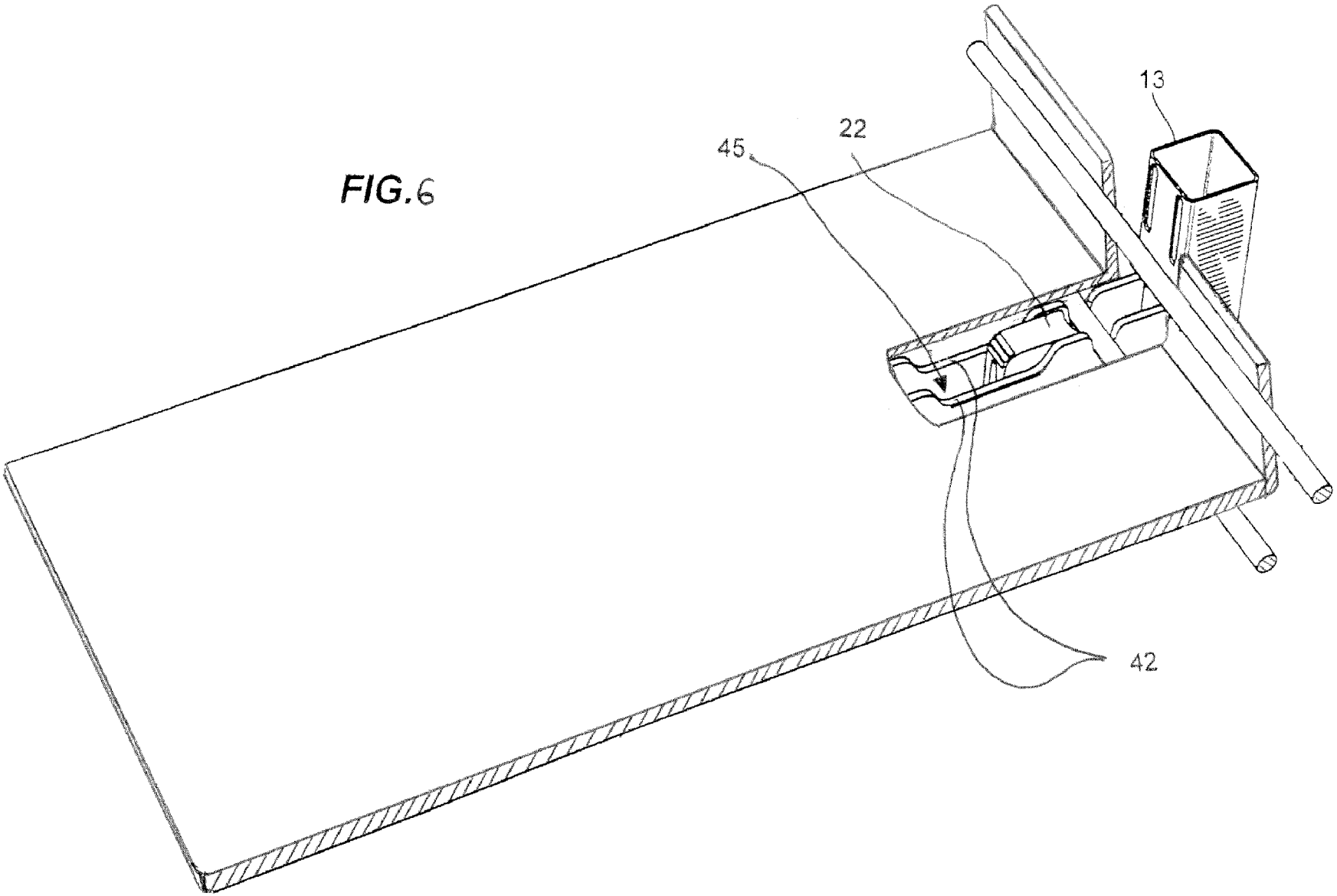
FIG. 6 shows a perspective view of the locking bracket system of FIG. 1 employed with a solid shelf, the solid shelf being partially cut away.

If a solid shelf is desired in lieu of the wire shelf 14, the solid shelf can be placed on the upper surface 42 of the shelf bracket 12, as shown in FIG. 6, because the upper cantilever tab 22 and top surface 43 of the shelf bracket lock 10 is not higher then the shelving plane 45 of the shelf bracket 12 This ensures that the solid shelf can lie flat without interference from the shelf bracket lock 10.

Although certain shelf bracket locks and shelf brackets have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A bracket lock comprising:

(a) a body including a top, a pair of sidewalls, and a pair of downwardly-depending legs, each of the downwardly-depending legs being at least partially defined by one of the sidewalls;

(b) an upper restraining portion attached the top of the body, the upper restraining portion extending rearwardly from the top of the body;

(c) each of the downwardly depending legs terminating at a respective lower sliding portion that extends in directions parallel to the upper restraining portion and laterally outward from the sidewall at least partially defining the associated downwardly-depending leg, the lower sliding portions also extending laterally outward from the upper restraining portion, each of the lower sliding portions comprising an upper finger and a lower cantilever tab, said upper finger and said lower finger cantilever tab defining a rearwardly-open slot therebetween; and (d) each of the lower cantilever tabs including an elongate recessed surface along a lower edge thereof and oriented in a direction perpendicular to the rearwardly-open slot.

2. The bracket lock of claim 1, wherein the upper restraining portion comprises an upper cantilever tab.

3. The bracket lock of claim 1, wherein the upper restraining portion includes a leading edge at a rear end thereof, the leading edge including an arcuate surface having an apex directed toward a front of the body facilitate pulling the bracket lock into an unlocked position.

4. The bracket lock of claim 1, wherein the body includes a rounded, knurled surface at a transition to the upper restraining portion to facilitate pushing the bracket lock into a locked position.

5. The bracket lock of claim 1, wherein the body branches into the downwardly-depending legs at a level of the bracket lock that is below the upper restraining portion.

6. A locking bracket system comprising:

(a) a bracket, the bracket comprising a pair of bracket sidewalls spaced apart from one another, each of the bracket sidewalls comprising an upper surface, a slot including a lower edge having a raised surface, and a groove disposed on the upper surface, the upper surface of the bracket sidewalls defining a shelving plane; and (b) a bracket lock disposed between the bracket sidewalls, the bracket lock comprising a body including a top, a pair of sidewalls, and a pair of downwardly-depending legs, each of the downwardly-depending legs being at least partially defined by one of the sidewalls of the body of the bracket lock, an upper restraining portion attached to the top of the body, the upper restraining portion extending rearwardly from the top of the body, each of the downwardly depending legs terminating at a respective lower sliding portion that extends in directions parallel to the upper restraining portion and laterally outward from the sidewall of the body of the bracket lock at least partially defining the associated downwardly-depending leg, the lower sliding portions also extending laterally outward from the upper restraining portion, each of the lower sliding portions of the bracket lock comprising an upper finger and a lower cantilevered tab, said upper finger and said lower cantilevered tab defining a rearwardly-open slot therebetween, and each of the lower sliding portions extending into, and being slidably received in, the slot of the adjacent bracket sidewall, each of the lower cantilever tabs including an elongate recessed surface along a lower edge thereof and oriented in a direction perpendicular to the rearwardly-open slot, the recessed surface being selectively engaged by the raised surface on the lower edge of the slot in which the lower sliding portion is received;

wherein the bracket lock is located below the shelving plane.

7. The locking bracket system of claim 6, the upper restraining portion comprising an upper cantilever tab.

8. The locking bracket system of claim 6, the sidewalls each comprising a terminal bracket tab.

9. The locking bracket system of claim 6, further comprising a shelf, wherein the shelf is a type selected from the group consisting of wire shelves and solid shelves.

10. The bracket lock of claim 6, wherein the upper restraining portion includes a leading edge at a rear end thereof, the leading edge including an arcuate surface having an apex directed toward a front of the body to facilitate pulling the bracket lock into an unlocked position.

11. The bracket lock of claim 6, wherein the body includes a rounded, knurled surface at a transition to the upper restraining portion to facilitate pushing the bracket lock into a locked position.

12. The locking bracket system of claim 6, wherein the body of the bracket lock branches into the downwardly-depending legs at a level of the bracket lock that is below the upper restraining portion.

* * * * *